US005154509A

United States Patent [19]

Wulfman et al.

[11] Patent Number: 5,154,509

[45] Date of Patent: Oct. 13, 1992

[54] LOW VOLTAGE MAGNETIC TRACK LIGHT SYSTEM

[75] Inventors: David R. Wulfman, St. Louis, Mo.; Charles A. Wiemeyer, Seattle, Wash.

[73] Assignee: 291, Inc., St. Louis, Mo.

[21] Appl. No.: 821,194

[22] Filed: Jan. 15, 1992

[51] Int. Cl.[5] ..... H01R 33/00

[52] U.S. Cl. ..... 362/226; 362/227; 362/398; 362/404

[58] Field of Search ..... 362/226, 398, 404, 227

[56] References Cited

U.S. PATENT DOCUMENTS 3,038,139 6/1962 Bonanno .
3,144,527 8/1964 Tolegian .
3,292,579 12/1966 Buchanan .
3,718,816 2/1973 Seelbach et al. ..... 362/226
4,422,137 12/1983 Watts .
4,538,214 8/1985 Fisher et al. .
4,688,154 8/1987 Nilssen .
4,719,549 1/1988 Apel .
4,745,537 5/1988 Cheung .
4,814,953 3/1989 Distasio .
4,828,505 5/1989 Shwisha .
4,861,273 8/1989 Wenman et al. .

*Primary Examiner*—Carroll B. Dority
*Attorney, Agent, or Firm*—Levy, Zito & Grandinetti

[57] ABSTRACT

A low voltage track lighting system is provided wherein the track transmits current at 12 V AC to standard quartz halogen 12 volt lamps. The track may be made of interlocking components, namely; an electrical strip made of copper tubes partially embedded in a flexible plastic member, and a metal bracket for attachment to a ceiling, wall, or other support. The attachment system between the track and a given fixture uses magnetic attraction, and wherein replaceable magnets in the mount of each fixture attach to the metal bracket of the track to hold the fixture in place and provide the force for contact with the electrical strip.

9 Claims, 2 Drawing Sheets

LOW VOLTAGE MAGNETIC TRACK LIGHT SYSTEM

BACKGROUND OF THE INVENTION

The present invention relates to low voltage track lighting systems that provide advantages that current systems do not provide, and wherein the flexibility of fixture placements permits the user to control light rather than be controlled by the need for light.

Various types of lighting systems have been provided, as for example as shown in prior U.S. Pat. Nos. 3,038,139 to Bonanno; 3,144,527 to Tolegian; 3,292,579 to Buchanan; 3,706,882 to Eby; 4,422,137 to Watts; 4,538,214 to Fisher and Miller; 4,688,154 to Nilssen; 4,719,549 to Apel; 4,745,537 to Cheung; 4,814,953 to Distasio; 4,828,505 to Skawisha; and 4,861,273 to Wenman, Bray and Porter. However, neither these prior patents nor any others known to applicants achieve the results accomplished by the present invention.

SUMMARY OF THE PRESENT INVENTION

A primary object of the present invention is to provide a low voltage magnetic track lighting system that can be used in environments varying from commercial installations to small residential systems, and wherein the lighting system provides increased flexibility of fixture placement.

Another object of the present invention is to provide a low voltage track lighting system wherein the attachment system between the track and a given fixture is based on magnetic attraction, and wherein replaceable magnets in the mount of each fixture attach to the metal brackets of the track to hold a fixture in place, and provide the force for contact with the electrical strip.

Another object of the present invention is to provide a low voltage track lighting system which utilizes a track to transmit current at 12V AC to standard 12V AC quartz halogen lamps, the track being made of a plurality of interlocking components.

Another object of the present invention is to provide a low voltage track lighting system wherein small magnets are placed within each individual fixture reducing both weight and cost in the power source, namely the track. With the present invention, all localized movement is isolated to mechanical joints in a given fixture. The connection between the fixture is non-adjustable so that the track and fixture contact is much simpler to manufacture, install, and mount.

A still further object of the present invention is to provide lighting systems wherein magnets function as the means to establish electrical contact and use physical support, not as electrical contacts themselves. The electrical contacts being distinct from the magnets, can be their own means devoted to issues of electrical transmission.

A still further object of the present invention is to provide low voltage track lighting systems which exploit the possibilities of exposed electrical contacts which low voltage systems allow, and wherein the fixture connection is to the track by way of their magnetic contacts which attach directly to exposed electrified strips in the track, the contacts being made of a suitable material such as copper plated steel and wherein the system has a transformer which steps down the voltage from standard house current to the low voltage which is then introduced into the track and carried into the fixture.

A still further object of the present invention is to provide low voltage magnetic lighting systems which are simple in design, rugged in construction and efficient and economical to manufacture and operate.

Further objects and advantages of the invention will become apparent from the following description and claims taken with the accompanying drawings wherein:

DESCRIPTION OF THE PREFERRED EMBODIMENTS

Figure 2:
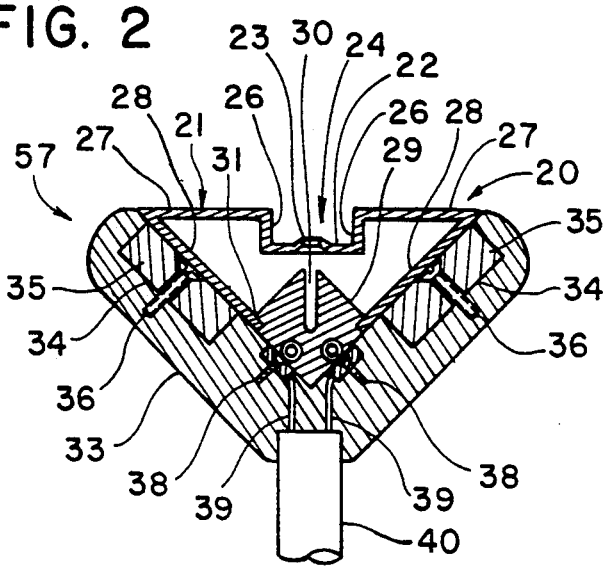
FIG. 2 is a sectional view thereof.
Figure 3:
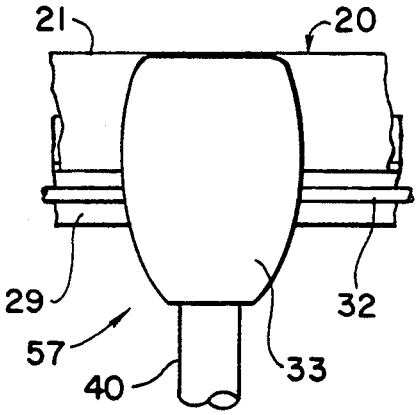
FIG. 3 is an elevational view of the assembly of FIG. 2.

Referring in detail to the drawings, the numeral 20 indicates the low voltage magnetic track lighting system of the present invention that includes a bracket 21 that can be made of a suitable material such as metal. As shown in FIG. 2, the bracket 21 may include a first portion 22 that has openings or apertures 23 therein whereby securing elements such as screws can be extended through the apertures 23 and into engagement with a member such as a ceiling, wall or the like. Portions 26 co-act with the portion 22 whereby there is defined a trough 24 in the bracket 21 for a purpose to be later described. Body portions 27 are arranged at right angles to the portions 26, and the bracket 21 further includes angularly arranged side portions 28.

An insulated strip 29 is provided as shown in the drawings, and the strip 29 has a slot or cutout 30 therein to provide flexibility for the strip. The strip 29 is provided with grooves or cutaway portions 31, FIG. 7, whereby edges of the side portions 28 can be snugly received in the grooves 31 when the parts are properly assembled. Conductor tubes 32 ar mounted in the strip 29.

The lighting system of the present invention further includes fixtures 57 that each comprise non-conductive plastic housings 33, FIG. 2, and the housings 33 are provided with recesses 34 for receiving magnets 35 therein, and the magnets 35 may have a circular shape. Securing elements such as screws 36 are provided for maintaining the magnets 35 secured in the housing 33, FIG. 4.

As shown in the drawings, electrical contact strips 37 are mounted in grooves or recesses in the housing 33, and the contact strips 37 may be made of a suitable material such as steel or copper. Securing elements such as screws 38 are provided for maintaining or retaining the strips 37 properly connected to the housing 33.

Wires 39 connect the strips 37 to isolated copper tubes 40 for conducting electrical current to the lamps 41 therebelow. The lamps or fixtures 41 may be supported by elements 43 which are connected to suitable supporting arms 42 that may have braces or support members 44 provided therefor.

Figure 6:
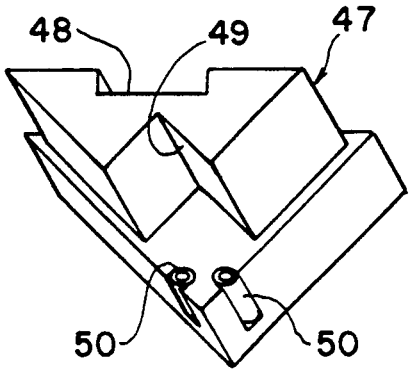
FIG. 6 is a perspective view of an end member or plug.

As shown in FIG. 6, there is provided a plug 47 that has a recess or cutaway portion 48 for coinciding with or matching the configuration of the track. The plug 47 further includes a recess 49, and tubes 50 which may be made of a suitable material such as copper are mounted in the plug 47.

Figure 7:
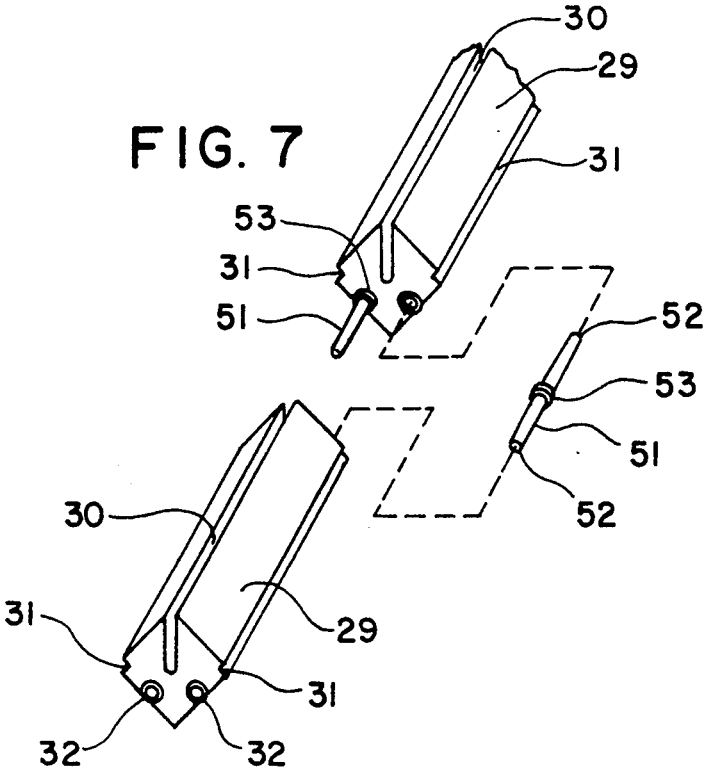
FIG. 7 is a perspective view showing several of the segments separated for clarity of illustration.

As shown in FIG. 7, a connecting pin 51 may be provided for connecting sections of the strips 29 together, and the pins 51 include tapered end portions 52 as well as an intermediate portion 53.

Figure 1:
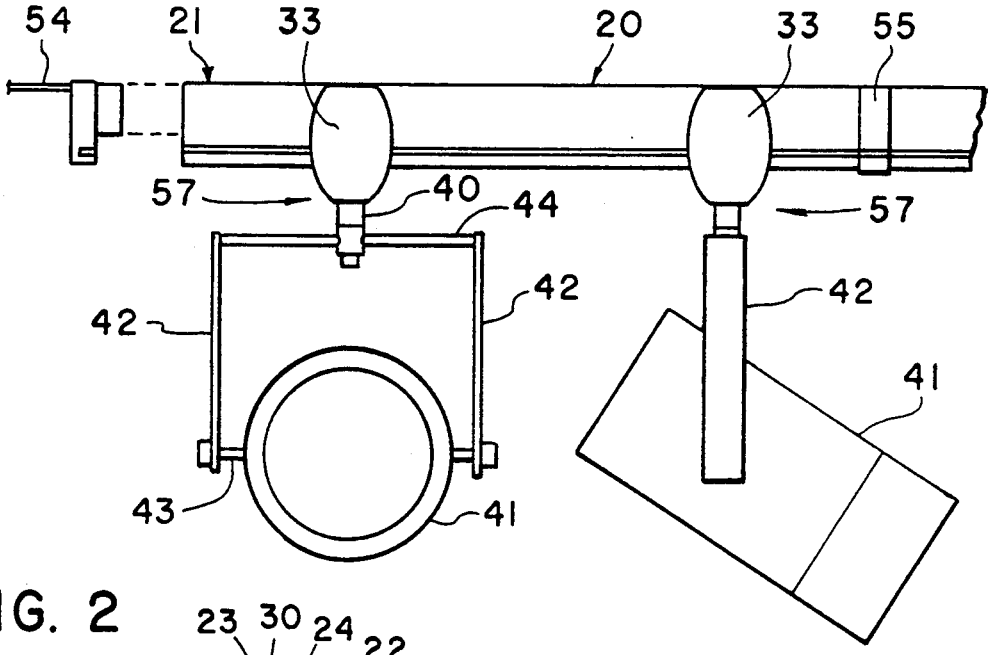
FIG. 1 is an elevational view of the light system of the present invention.

In FIG. 1, the numeral 54 indicates the connection to a transformer and the numeral 55 indicates a connection between adjacent sections of the brackets or track 21.

Figure 4:
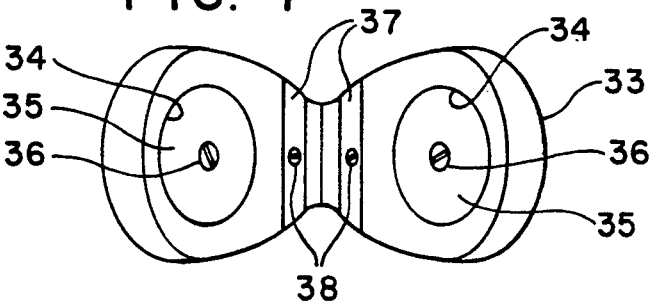
FIG. 4 is a plan view of a mount showing the magnets therein.
Figure 5:
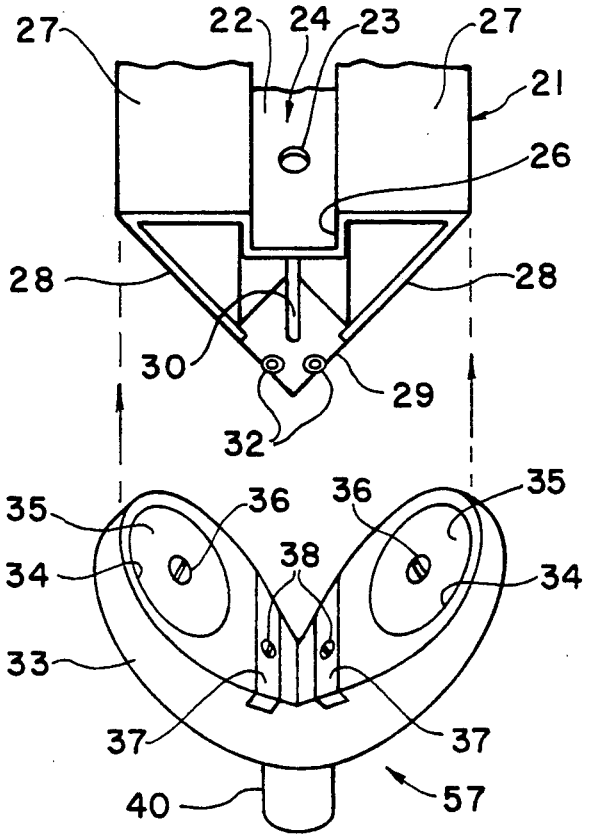
FIG. 5 is a fragmentary perspective view showing certain constructional details of the present invention.

From the foregoing, it will be seen that there has been provided a low voltage magnetic track lighting system, and in use with the parts arranged as shown in the drawings, the steel bracket 21 may be manufactured in sections such as 8' or 4' sections installed end-to-end. Installation holes 23 are provided for screws or anchors, FIG. 2; and the trough 24 is provided for insulated wire. The flexible nylon or rubber electrical strip 29 may be manufactured in a suitable length or rolls, and can be snugly pressed into the steel bracket 21 so that the edges of the portions 28 of the bracket 21 are received in the slots 31 of the rubber strips 29. Copper tubes 32 that may have 1/16" OD can be pressed into the strip 29, and suitable grooves or recesses can be provided in the strip 29 for receiving the copper tubes 32. Dimensions of the fixture mount 57 may be coordinated with the track as desired or required. FIG. 4 is a top view of a fixture mount 57. FIG. 2 is a sectional view taken through a fixture mount and corresponding portion of a track. The track or bracket 21 has round magnets 35 arranged in engagement therewith, and the round magnets 35 may be $\frac{3}{8}$" in diameter. The magnets 35 hold the fixture 52 to the track 21. The housing 33 is non-conductive and is adapted to be made of a suitable plastic material. Isolated copper tubes 40 and wires 39 electrically conduct electricity to the lamps 41 therebelow.

FIG. 7 illustrates the flexible rubber strips 29 that have the copper tubes therein, and the grooves 31 in the strips 29 receive the edge portions of the bracket 21. Connector pins 51 have end portions 52 which are adapted to engage corresponding end portions of the copper tubes 32 whereby a plurality of the strips 29 can be suitably connected together. The plug 47 shown in FIG. 6 can be made of a suitable plastic. The track can be connected to a transformer through connection 54, FIG. 1. The ends of the pins 51 are tapered so as to facilitate insertion of the pins 51 in the copper tubes 32.

It will be seen that there has been provided a low voltage track lighting system. Lighting requirements have changed a great deal since the introduction of fluorescent tubes and yet, fluorescent tubes remain the most common form of illumination for most environments. In accordance with the present invention, there is provided a track that transmits current at 12V AC to standard quartz halogen 12V lamps or other units. The tracks are made of two interlocking components: 1) an electrical strip made of copper tubes 32 partially embedded in a flexible rubber strip 29; and 2) a steel bracket 21 attached to a ceiling, wall or other support, and the bracket 21 functions as a structural spine for the strip 29. The attachment system between the track and a given fixture 57 is based on magnetic attraction. There is provided replaceable magnets 35 in the mount of each fixture which attach to the steel bracket 21 of the track, so as to hold a fixture 57 in place and provide the force for contact with the electrical strips 37.

It will be seen that the lighting system of the present invention provides options that present systems do not provide. Because the low voltage magnetic track light system of the present invention is inexpensive to manufacture and simple to install, the track can be used in environments that vary from commercial installations to small residential systems. Further, the flexibility of fixture placement permits the user to control light, rather than be controlled by the need for light.

The parts may be made of any suitable material and in different shapes or sizes as desired or required. Further, the system can be changed in certain minor ways; for example, the specific contours of the track can be varied, both inside and outside. The basic triangular shape of the track and its general assembly will not change. The trough 24 may change in shape or be eliminated entirely which makes the backside of the track subject to change as well as the shape of the electrical plugs to the track. Further, the actual metal electrical conductors inserted in the electrical strip assembly may or may not be made of copper, and may also change to a different profile other than that of a tube. While the tubes have been indicated to be made of copper, it is to be understood that such parts can be made of different materials and can have other sections besides being tubular. Further, because of the possible change in the shape of the trough of the track, the corresponding shape of the plug of FIG. 6 can change as well. FIG. 1 illustrates a typical fixture of no precise type of unit mounted to the track.

The present invention possesses certain important advantages and differences over the prior patents such as Apel U.S. Pat. No. 4,719,549. While Apel '549 uses magnets to establish an electrical contact and physical support, with the present invention there is proposed a different and better approach to this combination of ideas. For example, in FIGS. 4 through 8 of Apel '549, Apel proposes placing a magnet in the power source whether it be a single socket or magnetic rail. In contrast, the present invention utilizes smaller magnets placed with each individual fixture, reducing both the weight and cost in the power source which, in the present case, is the track.

FIGS. 4 through 8 of Apel '549 proposes an adjustable swiveling ball and socket-type of joint held together magnetically. At this joint, there is concurrently the electrical connection between the fixture and the power source. The present invention proposes no such concept. The connection between the electrified track and fixture does not rotate or swivel, nor is it adjustable. All localized movement is isolated to mechanical joints in a given fixture not including, of course, changing the location of a fixture anywhere along the length of a given track. By making the connection between the fixture and the track nonadjustable, applicants make the track and fixture contact much simpler to manufacture, install and maintain. Apel '549 makes the magnets function both as electrical contact and support. Specifically, looking at Apel's rail, he integrates the magnet in the rail into the electrical circuit, and in so doing he proposes different types of electrical contacts in the same system. In the present invention, the magnets function as the means to establish electrical contact and as physical support, not as electrical contacts themselves. The electrical contacts being distinct from the magnets can have their own system devoted to issues of electrical transmission.

In essence, applicants herein provide a low voltage track lighting system which utilizes exposed electrical contacts that a low voltage system allows. The fixtures connect to the track by way of their magnetic contacts which attach directly to exposed electrical strips in the track made of copper plated steel. The system has a transformer which steps down the voltage from standard house current to the low voltage which is then introduced into the track and carried on to the fixtures. With further reference to the low voltage magnetic track light system of the present invention, basically the system is made of two distinct parts. The first is an electrified track carrying 12V electrical current (the current can be AC or DC depending on the individual requirements of a given application). The second is a fixture mount which establishes both electrical and structural contact between a given lighting fixture and the track.

As to the track, the track is made of two distinct interlocking components which are put together at the time of its installation in a given location. These two components can be called the electric strip and the support channel. The electric strip is made up of two copper tubes partially embedded in a flexible nylon or other nonconductive flexible plastic or rubber. The copper tubes conduct electric current. It is projected that this component could be manufactured by means of an extrusion process, and be made available both in short lengths and in 25 or 50 foot rolls.

The support channel 21 can be made of bent sheet steel and is attached by means of screws or anchors to a ceiling, wall or other form of support. The channel can be manufactured and made available in four and eight foot lengths.

As to installation, the installation process is broken into two simple steps. The support channel 21 is mounted to a surface, mounting the lengths together end-to-end by means of anchors or screws. The support channel 21 can be cut to specific lengths by means of a saw used in cutting similar thin metal profiles like electrical conduit. The electrical strip is pressed into the support channel 21 as shown in the drawings. This electrical strip could also be cut to length by means of a small hand saw designed to cut metal.

As to the fixture mount, the fixture mount 57 is comprised of two magnets 35 which are embedded in a non-electrically conductive plastic housing 33. As shown in the drawings, the inside profile of the mount matches the outside profile of the fully assembled track. The magnets 35 are positioned to coincide with the steel support channel of the track, and the copper contacts are positioned to coincide with the location of the copper tubes 32 embedded in the electric strip 29.

The fixture mount is held to the track by means of its two magnets 35 attaching to either side of the steel support channel or bracket 21. The magnets 35 hold the fixture to the track and supply the necessary force to make electrical contact to the electric strip 29. By nature of the triangular shape of the track and mount, the attachment system is self centering. The system then allows the user to mount a fixture in one simple motion with one hand, or even with a clamping extension arm, in locations with high ceilings.

The transformer as at 54 steps the voltage down to 12V which is voltage that goes across the track. At this low voltage, the electric contacts along the track may remain exposed. The actual contact between the 12V fixture and the 12V track is made and maintained by magnets 35 in the fixture. Certain important aspects of the present invention are 1) as a result of carrying 12V instead of 110V (the standard), the track has a simpler profile which is lighter construction, made of lighter, less expensive materials which are flexible and 2) by separating the fixture from the transformer, the fixture is much lighter in weight. The contact between fixture and track need only be held by magnetic force, and the track need not be very strong or even rigid. The track need not be strongly attached to the ceiling, wall or other desired attachment surface.

As to the electric strip 29, this can be attached to the track structure by pressing it into place and consists of copper tubes partially embedded in rubber, and the purpose of the copper tubes is for electrical transmission, and the purpose of the rubber is for supporting and isolating the copper tubes. The purpose of the steel support channel 21 is to provide support to the electric strip and to provide a means of attachment by way of magnetism to the magnetic fixture mounts. The track is attached to the ceiling, wall or other chosen surface by small screws introduced into the track through predrilled holes 23 in the center lane of the track structure. The fixture contacts are held to the track by magnetic force. As a variation for the track, the same can be attached to a dropped ceiling grid and a dropped ceiling strut can be used in conjunction with acoustic ceiling tile. For installation, the track can be snapped over the face of the dropped ceiling strut, or attached directly to a dropped ceiling hanger.

While the preferred embodiments have been described, various modifications and substitutions may be made thereto without departing from the scope of the invention. Accordingly, it is to be understood that the invention has been described by way of illustration and not limitation.

We claim:

1. In a low voltage magnetic track lighting system, track means including a bracket;

means for attaching said bracket to a ceiling, wall or support;

strip means mounted in said track means;

conductor members mounted in said strip means;

housing means arranged contiguous to said bracket, there being recesses in said housing means;

magnets positioned in said recesses, means for securing said magnets in the recesses of said housing, said magnets engaging portions of the bracket, conductive strips mounted in said housing;

fixture means positively connected to said housing, and means electrically connecting said fixture means to said conductor strips.

2. The structure as defined in claim 1, wherein the track is triangular in shape and configuration.

3. The structure as defined in claim 2, wherein the track consists of a plurality of sections interconnected together.

4. The structure as defined in claim 3, wherein the magnets are circular in formation.

5. The structure as defined in claim 4, wherein strip members are interconnected by means of pins having tapered end portions.

6. As a new article of manufacture, a low voltage magnetic track lighting system comprising a track including a bracket, said track including a first portion having a trough therein, said trough being defined by a flat portion having apertures therein for receiving securing elements for attaching the track to a ceiling, wall or support; portions arranged at right angles to said flat portion, said bracket further including a body portion arranged at right angles to said last-named portions, angularly arranged side portions arranged at an angle with respect to the body portion; a flexible strip having grooves therein for receiving edges of the angularly arranged side portions of the bracket, there being a slot in said strip, fixtures including lamps, a housing positioned adjacent to the bracket, circular magnets mounted in said housing for engagement with portions of the bracket, conductor strips mounted in said housing, electrical conductors mounted in said strips and electrically engaging the contact members, and pins having tapered portions for interconnecting adjacent strips together.

7. The structure as defined in claim 6, wherein the strips are made of non-electrically conductive materials such as plastic or rubber.

8. The structure as defined in claim 7, wherein the housings are made of non-electrically conductive materials such as plastic.

9. In a low voltage magnetic track light system comprising, a track; components connected to said track and having exposed electrical conductors therein, means for interlocking said components, fixture mounts each including a plurality of magnets and electrical contacts, each of said fixture mounts being held to the track by means of the magnets and said electrical contacts adapted to contact said electrical conductors in said components.

* * * * *